US006389107B1

(12) United States Patent
Kantsyrev et al.

(10) Patent No.: US 6,389,107 B1
(45) **Date of Patent: *May 14, 2002**

(54) CAPILLARY POLARIMETER

(76) Inventors: Victor L. Kantsyrev; Reinhard F. Bruch; Alla S. Shlyaptseva, all of University of Nevada Reno, Department of Physics/220, Reno, NV (US) 89557-0058

( * ) Notice: Subject to any disclaimer, the term of this patent is extended or adjusted under 35 U.S.C. 154(b) by 0 days.

(21) Appl. No.: 09/305,853

(22) Filed: May 5, 1999

Related U.S. Application Data

(63) Continuation-in-part of application No. 08/829,043, filed on Mar. 31, 1997, now abandoned.
(60) Provisional application No. 60/014,483, filed on Apr. 1, 1996.

(51) Int. Cl.[7] ..... G21K 1/00
(52) U.S. Cl. ..... 378/145; 378/84
(58) Field of Search ..... 378/84, 83, 34, 378/145, 43, 207; 250/504, 505.1

(56) References Cited

U.S. PATENT DOCUMENTS 5,497,008 A * 3/1996 Kumakhov ..... 250/505.1
5,838,757 A * 11/1998 Vartanian ..... 378/43

OTHER PUBLICATIONS

P. Dhez, "Polarizers and Polarimeters in the X–UV Range," Nuclear Instruments and Methods in Physics Research, pp. 66–71.

E.S. Gluskin, S.V. Gaponov, P.Dhez, P.P. Ilyinsky, N.N. Salashchenko, Yu.M. Shatunov, E.M. Trakhtenberg, "A Polarimeter for Soft X–Ray and VUV Radiation," Nuclear Instruments and Methods in Physics Research, pp. 394–396.

E. Forster, R.J. Hutcheon, O. Renner, I. Uschmann, M. Vollbrecht, M. Nantel, A. Klisnick, P. Jaegle, "High–resolution x–ray imaging of extended lasing plasmas," Applied Optics, vol. 36 (No. 4), pp. 831–840, (Feb. 1, 1997).

Masanobu Watanabe, Takehiko Hidaka, Yoshinobu Mitsuhashi, "Upper Limits of Soft X–Ray Transmission Factors fo Curved Hollow–Core Glass Fibers," Journal of Lighwave Technology, vol. LT5 (No. 7), pp. 877–880, (Jul., 1987).

A. YA. Faenov, S.A. Pikuz, A.I. Erko, B.A. Bryunetkin, V.M. Dyakin, G.V. Ivanenkov, A.R. Mingaleev, T.A. Pikuz, V.M. Romanova, T.A. Shelkovenko, "High–Performance X–ray Spectroscopic Devices for Plasma Microsources Investigations," Physica Scripta, pp.333–338.

A.V. Rode, A.G. Peele and K.A. Nugent, D.E. Johnson, D.P. Siddons, "One–dimensional focusing of synchrotron x–ray radioation with curved arrays of reflectors," Rev. Sci. Instum., American Institute of Physics, vol. 66 (No. 2), pp. 2197–2199, (Feb., 1995).

R.G. Watt, J. Oertel, T. Archeluta, "Gated x–ray imager gain correction using a tapered microchannel–plate stripline," Rev. Sci, Intrum., American Institute of Physics, vol. 65 (No. 8), pp. 2585–2586 (Aug., 1994).

(List continued on next page.)

*Primary Examiner*—David P. Porta
(74) *Attorney, Agent, or Firm*—Ian F. Burns

(57) ABSTRACT

A system is provided for measuring the polarity and intensity of extreme ultraviolet, soft x-ray, and x-ray radiation. The system comprises a reflective surface, a capillary array, and a detector. The reflective surface is adapted to reflect radiation from a source on to a receiving end of the capillary array. The reflective surface may have a variety of shapes, such as a curved, parabolic shape or a flat shape, for reflecting the radiation in a desired manner. The capillary array may also have a variety of shapes for directing the radiation to the detector, such as a curved shape or a conical shape. The capillaries in the capillary arrays may have an inner diameter that decreases from the receiving end of the array to the emitting end of the array. This increases the flux density of the radiation emitted by the capillary array and helps the detector measure weak radiation.

20 Claims, 3 Drawing Sheets

OTHER PUBLICATIONS

Phil Bly and David Gibson, "Polycapillary optics focus and collimate x–rays," Laser Focus World, pp. 61–66, (Mar., 1996).

D. Mosher and S.J. Stephanakis, "X–ray "light pipes"," Applied Physics Letters, American Institute of Physics, vol. 29 (No. 2), pp. 105–107, (Jul. 15, 1976).

Masanobu Watanabe, Isao H. Suxuki, Takehiko HIdaka, Morotake Nishi, Yoshinobu Mitsuhashi, "Soft x–ray transmission characteristics of hollow–core fused–quartz fibers," Appied Optics, vol. 24 (No. 23), pp. 4206–4209, (Dec., 1985).

M.A. Kumakhov, "Channeling of Photons and New X–Ray Optics," Nuclear Instruments and Methods in Physics Research, Elsevier Science Publishers (North–Holland), pp. 283–286.

V.M. Pantojas, V.E. Kovanstev, J. Pant, S.A. Budkov, T.M. Hayes, P.D. Persans, "A polycapillary–based X–ray optical system for diffraction applications," Nuclear Instruments & Methods in Physics Research, Elsevier Science Publishers, pp. 607–617, (1993).

Edward A. Stern, Zwi Kalman, Aaron Lewis, Klony Lieberman, "Simple method for focusing x rays using tapered cappliaries," Applied Optics, vol. 27 (No. 24), pp. 5135–5129, (Dec. 15, 1988).

M. Vartanian, R. Youngman, D. Gibson, "Polycappillary collimator for point source proximity x–ray lithography," American Vacuum Society, J. Vac. Sci. Technol., vol. 11 (No. 6), pp. 3003–3007, (1993).

C.A. MacDonald, "Applications and Measurments of Polycapillary X–Ray Optics," Journal of X–Ray Science and Technology, Academic Press, Inc., pp. 32–47, (1993).

T. Hidaka, "Extremely Low–Loss Hollow Core Waveguide for VUV Light," Optics Communications, vol. 44 (No. 2), pp. 90–93, (Dec. 15, 1982).

N.M. Ceglio, A.M. Hawryluk, D.G. Sterns, M. Kuhne, P. Muller, "Demonstration of guided–wave phenomena at extreme–ultraviolet and soft–ray wavelengths," Optics Letters, Optical Society of America, vol. 13 (No. 4), pp. 267–269, (Apr., 1988).

J.E. Rowe, R.A. Malic, E.E. Chaban, R.J. Chichester, D.–M. Chiang, W.A. Royer, N.V. Smith, "Photon channeling in the vacuum–ultraviolet wavelength range," American Institute of Physics, Rev. Sci. Instrum., pp. 2203–2205, (1994).

N.V. Smith, W.A. Royer, J.E. Rowe, "Channeling of vacuum ultraviolet radiation down tapered capillaries and prospects for a photemission spectromicroscopy," American Institute of Physics, Rev. Sci. Instrum., vol. 65 (No. 6), pp. 1954–1958, (1994).

* cited by examiner

CAPILLARY POLARIMETER

CROSS REFERENCES TO RELATED APPLICATIONS

This application is a continuation-in-part application of U.S. patent application Ser. No. 08/829,043, filed on Mar. 31, 1997, now abandoned, which claims priority of provisional patent application Ser. No. 60/014,483, filed on Apr. 1, 1996, all of which is incorporated herein by reference.

BACKGROUND OF THE INVENTION

1. Field of Invention

This invention provides a means for measuring the polarity and the intensity of radiation that fall within the spectral ranges of extreme ultraviolet (EUV), soft x-ray (SXR), and x-ray (XR) radiation.

2. Description of Related Art

The measurement of the degree of polarization and the intensity of polarized EUV, SXR, and XR radiation are important in a number of fields of research. For example, these measurements may be used in the analysis of hot dense plasmas in thermonuclear research, in astronomical observation of stars and the sun, in investigations of interactions of ions, atoms, and molecules with solid surfaces, and in the determination of fundamental atomic constants in x-ray diffractometry.

As seen in FIG. 1, a beam of radiation 100, incident upon a smooth, flat, reflective, surface 102 at any arbitrary angle 104, is conveniently represented by two vibrations: one parallel and one perpendicular to the plane of incidence. Standard notation refers to these components as $E_s$ (s-perpendicular component) and $E_p$ (p-parallel component). The polarization of radiation is generally measured by comparing the differences between the coefficients of reflection of the $E_s$ and $E_p$ components of the radiation beams from optical surfaces. The coefficient of reflection is defined as the ratio of the intensity of radiation reflected from an optical surface divided by the intensity of radiation directed onto that surface. The degree of polarization P is defined as follows:

$$P=|E_s-E_p/E_s+E_p|$$

Prior art methods and devices utilized to measure the degree of polarization of EUV, SXR, and XR beams generally involve measurements of the coefficients of reflection from a reflective surface, such as a crystal or multi-layer x-ray mirror, when the incidence of the beam relative to the reflective surface (θ) is at an angle close to the total polarization angle (Brewster's angle). The total polarization angle for EUV, SXR, and XR radiation is typically between 41 to 49 degrees.

Referring to FIG. 2, prior art devices generally utilize a measurement system 200 comprising a reflective surface 202, e.g., a multi-layer mirror or crystal, a detector or sensor 204, and a filter 206. A beam of radiation 212 from a source 210 passes through filter 206, which removes unwanted radiation from the beam. Once beam 212 passes through filter 206, it falls on reflective surface 202 and is reflected to detector 204, which is adapted to measure the intensity of beam 212. The radiation reflected by reflective surface 202 is monochromatic because reflective surface 202 absorbs all but a narrow band of reflected radiation. Reflective surface 202 is then rotated around an axis 208 that is parallel to beam 212 so that beam 212 can be measured in different planes of vibration. In order to measure beam 212 in different planes, detector 204 may be rotated in unison with reflective surface 202.

Once measurements have been obtained of the intensity of the radiation in different angular positions around axis 208, the measurements can be used to determine the polarity of the radiation. This method is applicable for measuring the polarization of continuous beams of radiation at wavelengths below 35.0 nm.

One of the disadvantages of this method is that reflective surface 202 is only capable of reflecting a narrow band of radiation at an angle of 45 degrees. Radiation with greater or lesser wavelengths outside of this band of radiation is absorbed by the reflective surface. In order to measure wavelengths outside of this narrow band, it is necessary to change the reflective surface. Moreover, in the wide spectral region with wavelengths greater than 30.0–50.0 nm, the polarization of a beam of radiation results in multiple reflections from flat metallic mirrors (i.e., mirrors covered with gold), when the mirrors are rotated around the axis of radiation. To perform polarization measurements, preliminary monochromatization of the beam of radiation is required by means of a diffraction grating. However, incorporating a diffraction grating complicates the construction of the polarization device and decreases its brightness.

The processes and systems of the present invention are based upon:

1. The enhancement of differences in the reflection properties of p and s polarized beams of EUV, SXR or XR radiation following multiple reflections of radiation from optical smooth surfaces (including multi-layer mirrors and crystals);
2. The guiding and focusing of beams of EUV, SXR and XR radiation resulting from multiple reflections of radiation from inner optical smooth surfaces of single capillaries (including capillaries with additional reflectance layers on the inner surface) in polycapillary bundles; and
3. The analysis of the spectral components of beams of EUV, SXR, or XR radiation following their reflection from dispersive optical elements such as multi-layer mirrors or crystals.

The reflectance of EUV radiation from a smooth surface is different from the reflectance of SXR or x-rays. For SXR, the difference between $E_s$ and $E_p$ is smaller than $10^{-2}$, while for EUV the distinction between $R_s$ and $R_p$ is relatively large. For EUV radiation, the Total Reflection Coefficient (R) is seen to be rather large ($R \approx 0.85$–$0.95$, up to the angle of incidence $\theta > 85°$) assuming multiple reflections of EUV radiation inside a capillary, particularly a curved capillary, but which occurs in any capillary array. This has been successfully demonstrated experimentally. The substantial difference between $E_s$ and $E_p$ for EUV radiation provides the opportunity for the measurement of the degree of polarization of EUV radiation using capillary array technology.

A most advantageous application of this invention is the ability to measure at the same time the polarization and spectral characteristics of the radiation beam. Because these processes and devices can focus the polarized radiation beam onto the detector, an additional advantage is their ability to aid in the analysis of weak beams of radiation. This invention can be used in the diagnostics of hot plasma, in x-ray astronomy, in atomic physics, surface analysis, crystallography, medical and biological x-ray diffractometry, and x-ray microscopy.

SUMMARY OF INVENTION

BRIEF DESCRIPTION OF THE INVENTION

Briefly stated, the present invention comprises a system for measuring the polarization and intensity of extreme ultraviolet, soft x-ray, and x-ray radiation produced by a source of radiation. The system comprises a reflective surface, a capillary array, and a detector. The reflective surface is adapted to reflect the radiation produced by the source. The capillary array is adapted to transmit the radiation. The capillary array comprises a receiving end positioned to receive the radiation reflected by the reflective surface and an emitting end. The detector is positioned to receive radiation emitted by the emitting end of the capillary array, the detector being adapted to measure the intensity of the emitted radiation.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Figure 1:
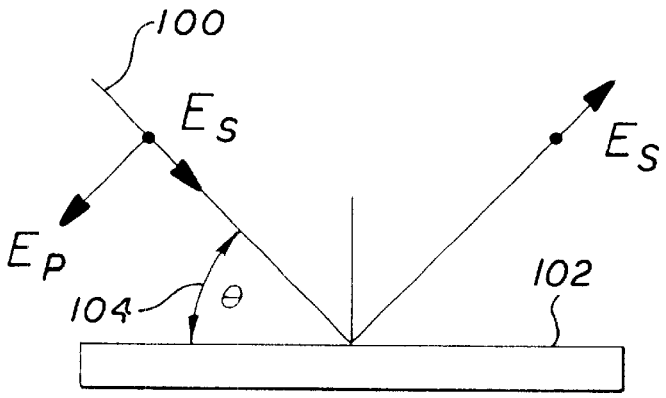
FIG. 1 is substantially a schematic of a beam of polarized radiation striking a reflective surface.
Figure 2:
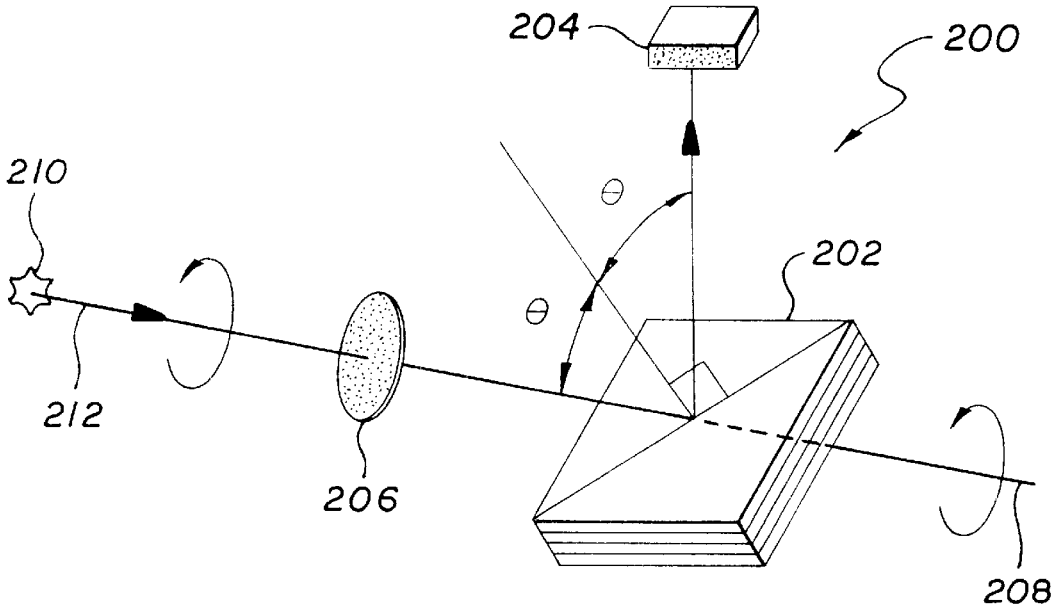
FIG. 2 (PRIOR ART)
FIG. 2 is substantially a schematic of a prior art system for measuring the polarity of a bean of radiation.
Figure 3:
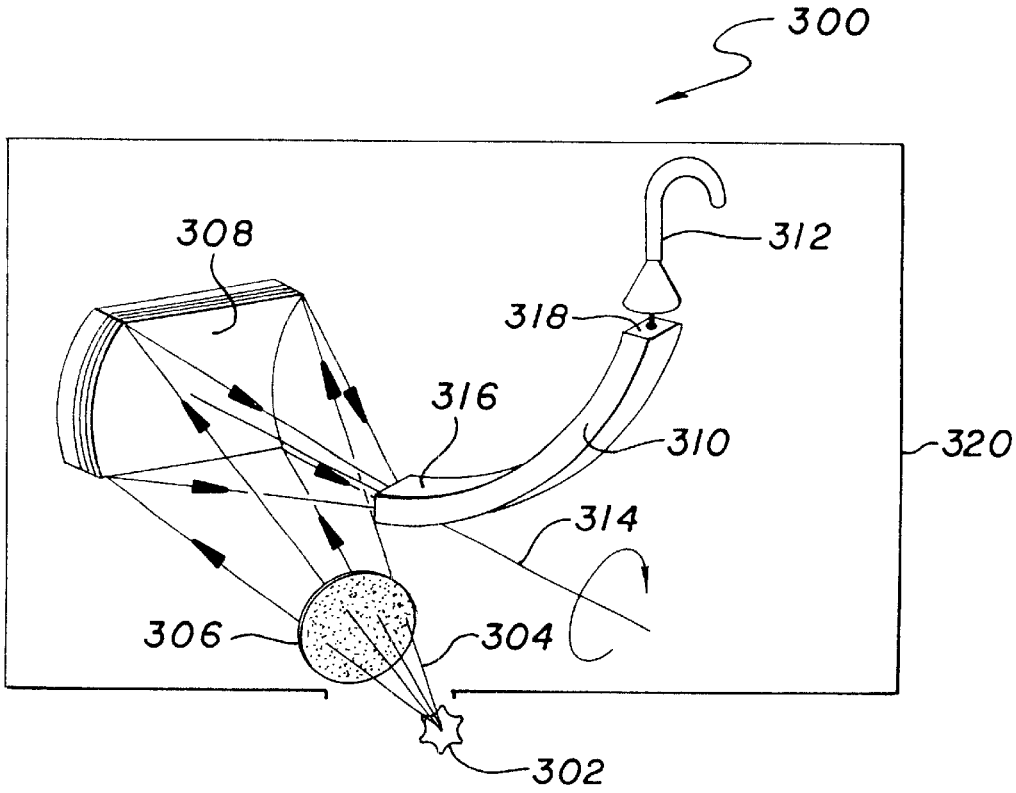
FIG. 3 is substantially a schematic of a preferred embodiment of the system of the present invention.

As seen in FIG. 3, one preferred embodiment of the present invention comprises a capillary polarimeter system generally indicated by reference number 300. Polarimeter 300 comprises filter 306, reflective surface 308, capillary array 310, and detector 312. A radiation source 302 produces radiation 304 that is directed toward filter 306. Filter 306 absorbs or blocks unwanted radiation, such as infrared, visible, and ultraviolet radiation. Filter 306 may be a plastic or metal film that is capable of absorbing the undesired radiation.

After passing through filter 306, radiation 304 falls on reflective surface 308. Reflective surface 308 is preferably a multi-layer mirror for spectral region 50.0 nm>$\lambda$>2.5 nm or crystal for spectral region $\lambda$<2.5 nm of a type that is well known in the art and is capable of reflecting radiation 304 in the EUV, SXR, and XR wavelengths. In the embodiment shown in FIG. 3, reflective surface 308 is concave having a parabolic, toroidal, or hemispherical cross-section. This shape allows reflective surface 308 to focus and concentrate radiation on a receiving end 316 of capillary array 310. The angle between the axis of the incident radiation and the axis of the reflected radiation is preferably less than 10°. Reflective surface 308 produces a negligible influence on the polarization of radiation 304 when the angle of reflection is close to normal.

Figure 3A:
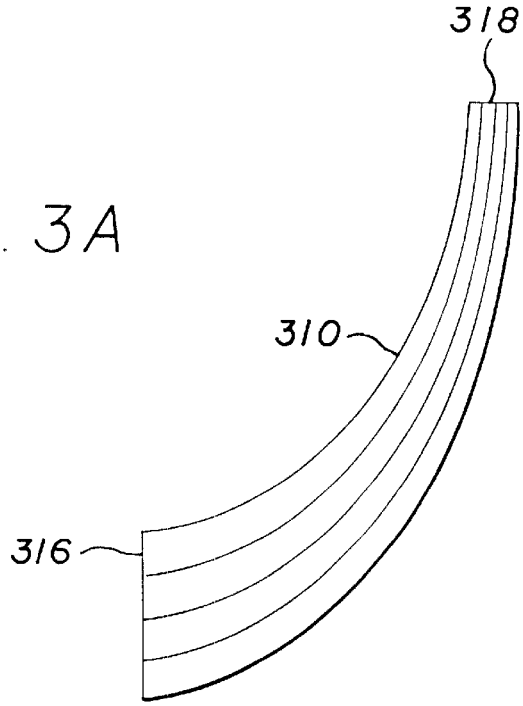
FIG. 3A is substantially a schematic of a cross-section of the capillary array utilized in the embodiment illustrated in FIG. 3.

As seen in FIG. 3A, capillary array 310 comprises a plurality of hollow glass or quartz capillaries combined to form an array or bundle. It is well known in the art that hollow glass or quartz capillaries with open ends may be used to guide or direct short wavelength radiation. For example, the device disclosed in U.S. Pat. No. 5,192,869 utilizes capillaries to direct and focus beams of radiation. The individual capillaries in capillary array 310 may range from 4 micrometers to 1.5 millimeters.

Capillary array 310 also comprises a proximal end or receiving end 316 and a distal end or emitting end 318. Proximal end 316 is positioned to receive radiation 304 reflected from reflective surface 308 and distal end 318 is positioned to emit radiation 304 on to detector 312.

Capillary array 310 may be formed in a number shapes to guide or direct radiation in different paths to achieve different results. The embodiment illustrated in FIGS. 3 and 3A utilizes a curved shape that redirects the radiation by ninety degrees. The multiple reflections that occur during the transmission of radiation through these bent capillaries results in an amplification of the differences in the coefficients of transmission of p-type and s-type radiation. However, it is recognized that other embodiments may utilize linear capillary arrays.

The individual capillaries in capillary array 310 may have a variety of cross-sections, such as square, circular, and triangular, and they may be coated with a variety of reflective substances. The accuracy of measurements of the degree of polarization depends on the ratio of intensities of meridional and sagittal rays exiting capillary array 310. The meridional rays are propagated in the same way inside capillaries of any cross sectional shape (circular, square, or triangular), if reflections take place along the longitudinal inner surface of capillary. For square or triangular cross sectional shaped capillaries, the attenuation of sagittal rays is much larger than it is for meridional rays.

The situation is more complicated for circular capillaries as the sagittal rays always have a larger number of reflections and smaller reflection angles than do meridional rays. However, because of a dependence of the coefficient of reflection of radiation in the EUV spectral region upon the incidence angle, the difference in this coefficient is negligible for incidence angles between 85°–89°. The number of reflections of the rays inside the capillary is the primary factor if the capillary is long enough. For example, using the results reported in references, in a circular quartz capillary (inner diameter $\phi$=0.5 mm, radius of curvature r=100 mm, angle of curvature of the capillary from 45° to 90°, $\lambda\approx$30.0–60.0 nm) the intensity of meridional rays are several times larger than the intensity of sagittal rays. Therefore, a capillary array with a circular cross section shape can also be used for polarization measurements in the EUV spectral region, but only if r/$\phi$>500–1000 (for $\phi$>50 $\mu$m).

Capillary array 310 may also comprise a tapered cross-section to focus and intensify the transmitted radiation. In this embodiment, the inner diameter of each capillary gradually narrows from proximal end 316 to distal end 318. As radiation is transmitted through a capillary, it is reflected many times and concentrated into a smaller area at distal end 318, thereby increasing the flux density of the radiation.

Detector 312 is a detector that is well known in the art that is capable of detecting EUV, SXR, and XR radiation. It may be linked to a computer system (not shown) for recording measurements. In the embodiment shown in FIG. 3, detector 312 is mechanically linked to capillary array 310 so that the capillary array and detector may be rotated around axis 314. When system 300 is operating, capillary array 310 and detector 312 are rotated up to 90 degree around axis 314 to measure radiation 304 in different planes or vibration. The polarization of radiation 304 may then be determined by comparing the intensities of the radiation in different angular orientations. Axis 314 is substantially parallel to the incoming path of radiation 404.

Most of the components of system 300 are housed in a vacuum chamber 320. Because of the large coefficients of attenuation of radiation with wavelength greater than 0.3 nm in air, all measurements in this spectral region must be conducted in a vacuum. Vacuum chamber 320 provides this vacuum.

Figure 4:
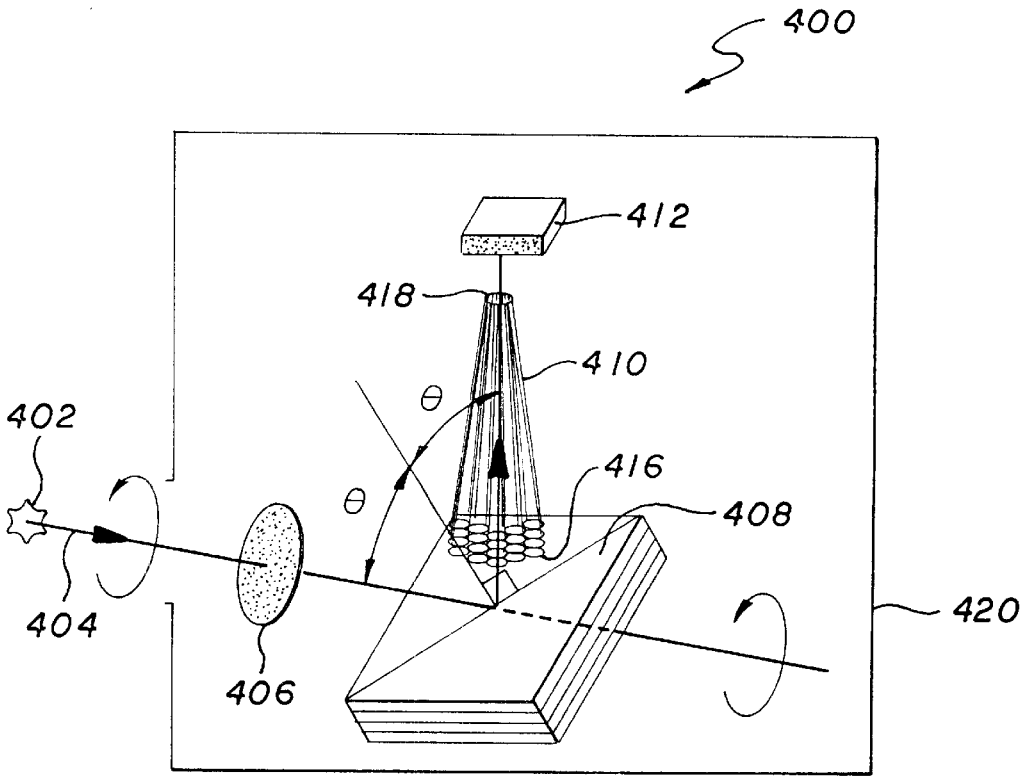
FIG. 4 is substantially a schematic of an alternative preferred embodiment of the system of the present invention.

FIG. 4 discloses an alternative preferred embodiment of a capillary polarimeter system generally indicated by reference number 400. Polarimeter 400 comprises filter 406, reflective surface 408, capillary array 410, and detector 312. As in the previous embodiment, a radiation source 402 produces radiation 404 that is directed toward filter 406. Filter 406 absorbs or blocks unwanted radiation, such as infrared, visible, and ultraviolet radiation and it may be manufactured from plastic or metal film that is capable of absorbing the undesired radiation.

After passing through filter 406, radiation 404 falls on reflective surface 408. In the embodiment shown in FIG. 4, reflective surface 408 is flat having a substantially planar surface that is mounted so that the angle of incidence of radiation 404 is approximately 45 degrees to the planar surface. Reflective surface 408 is adapted to rotate around an axis that is substantially parallel to the axis of radiation 404. As in the previous embodiment, reflective surface 408 may be either a multi-layer mirror or a crystal.

Figure 4A:
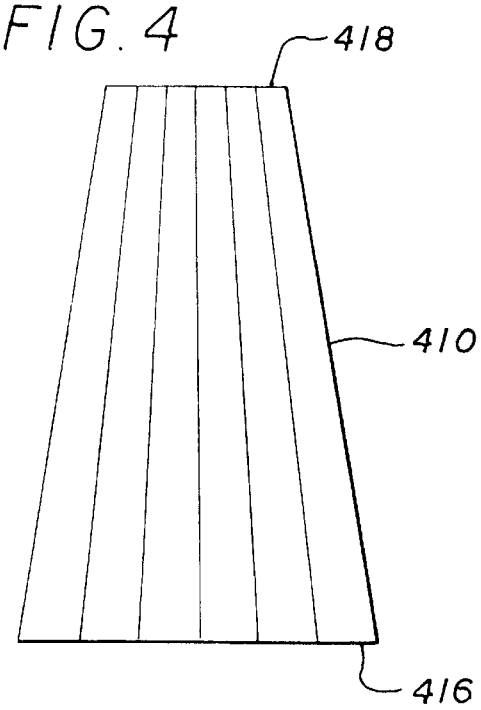
FIG. 4A is substantially a schematic of a cross-section of the capillary array utilized in the embodiment illustrated in FIG. 4.

Capillary array 410 is mounted such that radiation 404 reflected from reflective surface 408 falls on proximal or receiving end 416 and distal or emitting end 418 emits radiation on to detector 412. In this embodiment, capillary array 410 is not curved like capillary array 310 illustrated in FIG. 3. As seen in FIG. 4A, capillary array 410 has a generally conical shape. The inner diameter of the individual capillaries gradually decreases from proximal end 416 to the distal end 418 of capillary array 410. As in the previous embodiment, the decreasing inner diameter increases the flux density of the transmitted radiation.

Most of the components of polarimeter 400 are housed in a vacuum chamber to provide a vacuum for decreasing attenuation due to atmospheric gases.

In normal operation, reflective surface 408, capillary array 410, and detector 412 are rotated in unison from zero to 90 degrees when radiation 404 is being produced by source 402. This reflected beam of radiation is monochromized and it is directed to proximal end 416 of capillary array 410. Capillary array 410 intensifies radiation 404 and transmits it to detector 412.

The measurement of the polarization of radiation 404 is made by comparing the intensity of the beam on the detector before and after the rotation of the reflective surface 408. The ratio of intensities of p and s polarizations being dependent upon the angular position of reflective surface 408. This device is applicable for measurements in the short wavelength spectral region $\lambda<2.5$ nm (if a crystal is used for reflective surface 408) or in the spectral region 50.0 nm$>\lambda>$2.5 nm (if a multi-layer mirror is used for reflective surface 408).

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A system for measuring the polarization and intensity of extreme ultraviolet, soft x-ray, and x-ray radiation produced by a source, comprising:

(A) a reflective surface, the reflective surface being adapted to reflect the radiation produced by the source, wherein the reflecting surface is adapted to rotate around an axis, the axis being substantially parallel to an incoming path of the radiation reflected by the reflective surface;

(B) a capillary array being adapted to transmit the radiation, the capillary array comprising:

(a) a receiving end positioned to receive the radiation reflected by the reflective surface; and (b) an emitting end; and (C) a detector positioned to receive radiation emitted by the emitting end of the capillary array, the detector being adapted to measure the intensity of the emitted radiation.

2. The system of claim 1 wherein the reflecting surface comprises a concave shape.

3. The system of claim 1 wherein the reflecting surface is a multi-layer mirror.

4. The system of claim 1 wherein the reflecting surface is a crystal.

5. The system of claim 1 wherein the capillary array and the detector are adapted to rotate around the axis, wherein the reflective surface, the capillary array, and the detector may be maintained in the same angular position relative to each other when the reflective surface is rotated around the axis.

6. The system of claim 1 wherein the capillary array is adapted to rotate around an axis, the axis being substantially parallel to an incoming path of the radiation reflected by the reflective surface.

7. The system of claim 1 wherein the capillary array comprises at least one hollow capillary, the capillary having an inner diameter, the inner diameter gradually decreasing from the receiving end of the capillary array to the emitting end of the capillary array, wherein the flux density of the radiation is increased as the radiation is transmitted by the capillary array.

8. The system of claim 1 wherein the capillary array comprises a substantially conical shape.

9. The system of claim 1 wherein the capillary array comprises a substantially arced shape.

10. The system of claim 1 further comprising a filter positioned between the source and the reflective surface, the filter being adapted to prevent unwanted radiation from falling on the reflective surface.

11. The system of claim 1, wherein the capillary array has a plurality of capillaries, each capillary arced in the same direction.

12. A system for measuring the polarization and intensity of extreme ultraviolet, soft x-ray, and x-ray radiation produced by a source, the system comprising:

(A) reflector means for reflecting radiation from the source;

(B) capillary array means for transmitting radiation from the reflector means;

(C) detector means for measuring the intensity of the radiation transmitted from the capillary array means in a plurality of angular positions relative to an incoming path of the radiation, whereby the detector means can measure the intensity of radiation in a plurality of planes of vibration of the radiation; and (D) means for rotating the capillary array means and the detector means around an axis that is substantially parallel to the incoming path of radiation.

13. The system of claim 12 further comprising means for increasing flux density of the radiation as the radiation is transmitted by the capillary array means.

14. The system of claim 12 further comprising means for rotating the reflector means around an axis that is substantially parallel to the incoming path of radiation.

15. The system of claim 12, wherein the capillary array means has a plurality of capillaries, each capillary arced in the same direction.

16. A method of measuring the polarity and intensity of extreme ultraviolet, soft x-ray, and x-ray radiation, the method comprising the following steps:

(A) reflecting the radiation on to a capillary array;

(B) using the capillary array to transmit the radiation to a detector; and (C) measuring the intensity of the radiation using the detector, the detector being in a first angular position relative to the incoming path of the radiation.

17. The method of claim 16 further comprising the following steps:

(A) rotating the capillary array and the detector relative to an axis that is substantially parallel to the incoming path of radiation, wherein the capillary array and the detector are positioned in a second angular position relative to the incoming path of the radiation;

(B) measuring the intensity of the radiation using the detector in the second position.

18. The method of claim 17 further comprising the step of comparing the intensity of the radiation in the first and second positions.

19. The method of claim 16 further comprising the step of increasing the flux density of the radiation before measuring the intensity of the radiation.

20. The method of claim 17 further comprising the step of rotating the reflective surface relative to the incoming path of the radiation.

* * * * *